United States Patent [19]

Chambless et al.

[11] 4,278,278

[45] Jul. 14, 1981

[54] MEANS FOR TENSIONING TUBING IN A WELLHEAD ASSEMBLY

[75] Inventors: Joe G. Chambless; Paul E. McGlasson, both of Shreveport, La.

[73] Assignee: W-K-M Wellhead Systems, Inc., Shreveport, La.

[21] Appl. No.: 71,213

[22] Filed: Aug. 30, 1979

[51] Int. Cl.[3] ..... F16L 39/00

[52] U.S. Cl. ..... 285/143; 166/85; 166/240; 285/361

[58] Field of Search ..... 285/143, 142, 140, 360, 285/361; 166/240, 85

[56] References Cited

U.S. PATENT DOCUMENTS

| | | | |
|---|---|---|---|
| 3,011,552 | 12/1961 | Rhodes et al. | 285/142 X |
| 3,356,142 | 12/1967 | Crow et al. | 166/240 X |
| 3,500,909 | 3/1970 | Beyer | 166/240 X |
| 4,135,577 | 1/1979 | Nelson et al. | 166/240 X |

*Primary Examiner*—Thomas F. Callaghan

*Attorney, Agent, or Firm*—Eugene N. Riddle; Stephen T. Belsheim

[57] ABSTRACT

A tubing string (86) is connected at its upper end to a hanger (42) and has its lower end anchored within an outer casing. The hanger and tubing string are lifted from a position below the wellhead assembly to tension the tubing string a desired amount. The hanger has a plurality of guide pins (90) extending from and spaced about the outer periphery of the hanger. Upon lifting of the hanger and suspended tubing string, the guide pins enter inverted J-slots (62) in the hanger bowl (30) which receive and guide the pins to a seated position on the bowl.

7 Claims, 5 Drawing Figures

MEANS FOR TENSIONING TUBING IN A WELLHEAD ASSEMBLY

BACKGROUND OF THE INVENTION

A tubing string which is normally suspended from the wellhead may be several thousand feet in length and it is desirable to place the tubing under some tension, particularly when the tubing string might be subjected, for example, to relatively large variations in temperature, vibrations, a pumping action, or the cycling of certain fluids. The desired amount of tensioning for the tubing string may be estimated depending on various factors such as the thickness of the pipe string, the type of pipe string material, the length of the string, and the expected temperature changes.

For stretching or lifting a tubing string, the lower end of the tubing string is anchored such as by a suitable tension packer which may be easily run and set at the desired depth by a suitable tool such as by rotation of the tubing or tool to actuate the packer. A mandrel is normally threaded within a hanger supporting the upper end of the tubing string. The mandrel is lifted by a suitable hoisting mechanism along with the hanger and tubing string from a position below the wellhead with the amount of tension being calculated to indicate the distance that the hanger and tubing string is to be lifted for the desired tensioning of the tubing string.

Heretofore, separate members had been utilized for seating the tubing string in the wellhead assembly after the tensioning of the tubing string. As an example, reference is made to U.S. Pat. No. 3,011,552 dated Dec. 5, 1961 in which an apparatus for setting pipes in tension is illustrated. The lower end of the tubing string is anchored and the tubing string is "stretched" or pulled upwardly for the desired amount of tension. Then a sleeve is positioned around the tubing string joint and seated to maintain the tensioning. It is apparent that the positioning and seating of the separate sleeve by suitable threads is time consuming and requires close fitting elements.

DESCRIPTION OF THE PRESENT INVENTION

The present invention is directed to an arrangement for easily coupling or connecting the hanger and suspended tubing string within a supporting hanger bowl after the tubing string has been "stretched" or pulled upwardly to obtain the desired longitudinal tensioning. The hanger and hanger bowl from which the hanger is suspended have cooperating interfitting parts which are engaged in interfitted supporting relation upon the lifting and subsequent lowering of the hanger and tubing string. The interfitting parts comprise a plurality of cam slots spaced about the inner periphery of the hanger bowl, each cam slot being of a generally inverted "J" configuration, and a plurality of extending pins spaced about the outer periphery of the hanger which are received within and seat on the cam slots upon a lifting of the hanger and a subsequent lowering onto the pin seats formed by the cam slots. No further action or movement is required after the pins are seated within the slots and no additional parts or members are required in order to maintain the desired longitudinal tensioning on the pipe or tubing.

In the accompanying drawings in which one possible embodiment of the invention is illustrated:

Figure 4:
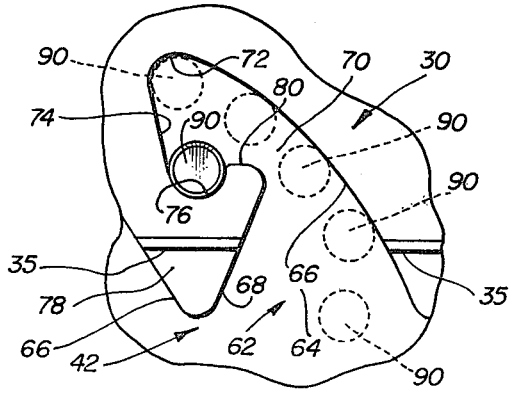
Figure 5:
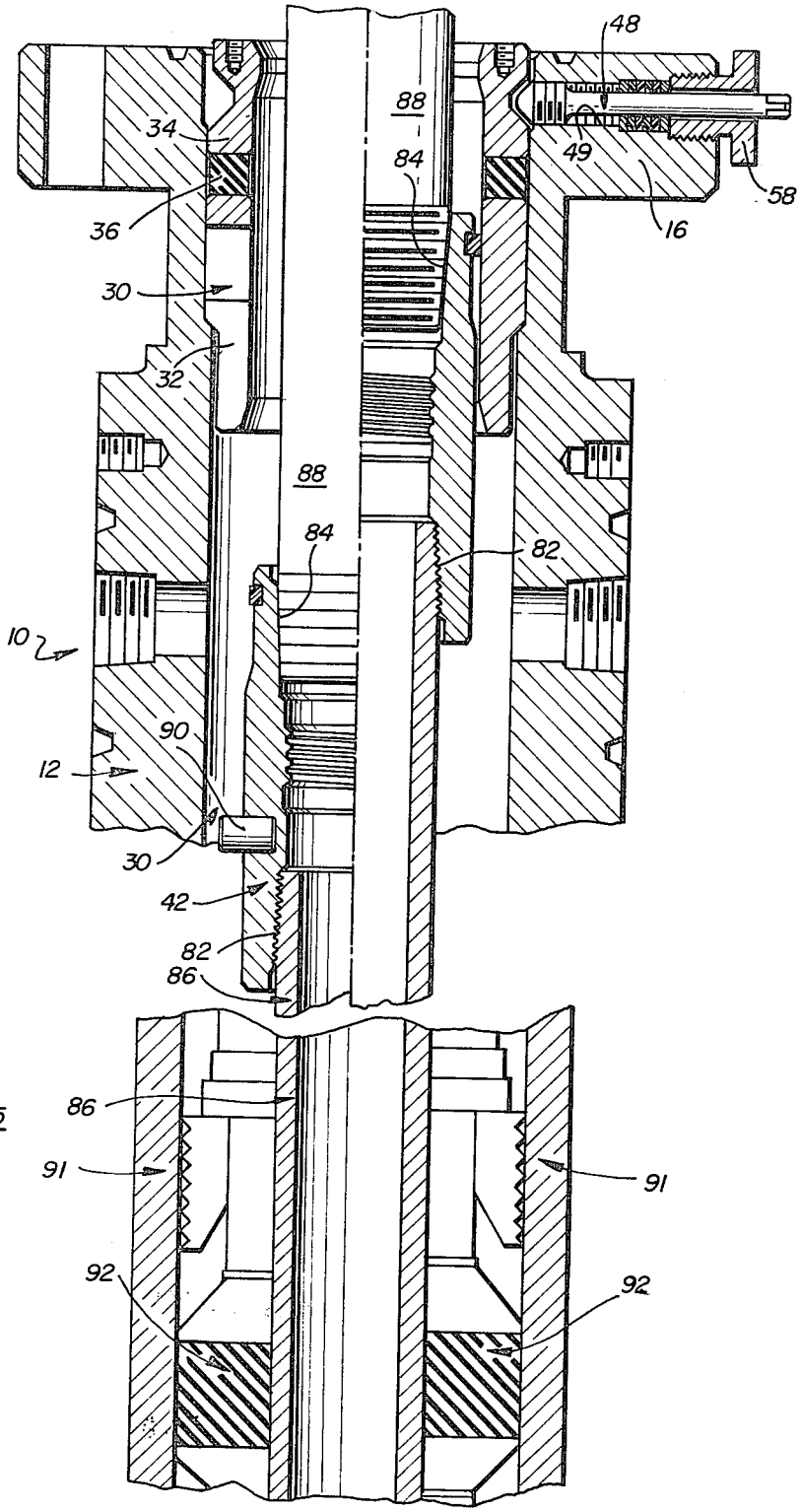

FIG. 4 is a partial side elevational view of the hanger in seated position in the inverted J-slot configuration of the hanger bowl with the broken line representation of the supporting pin showing the path of the hanger as it is lifted upwardly and lowered into seated, supported position on the hanger bowl; and FIG. 5 is a longitudinal sectional view of the wellhead illustrating the tubing string and hanger being lifted by a mandrel to tension the tubing string with the lower end of the tubing string being anchored within the casing, the separate halves of the view showing the hanger and upper end of the tubing string at different heights with respect to the wellhead assembly.

Figure 1:
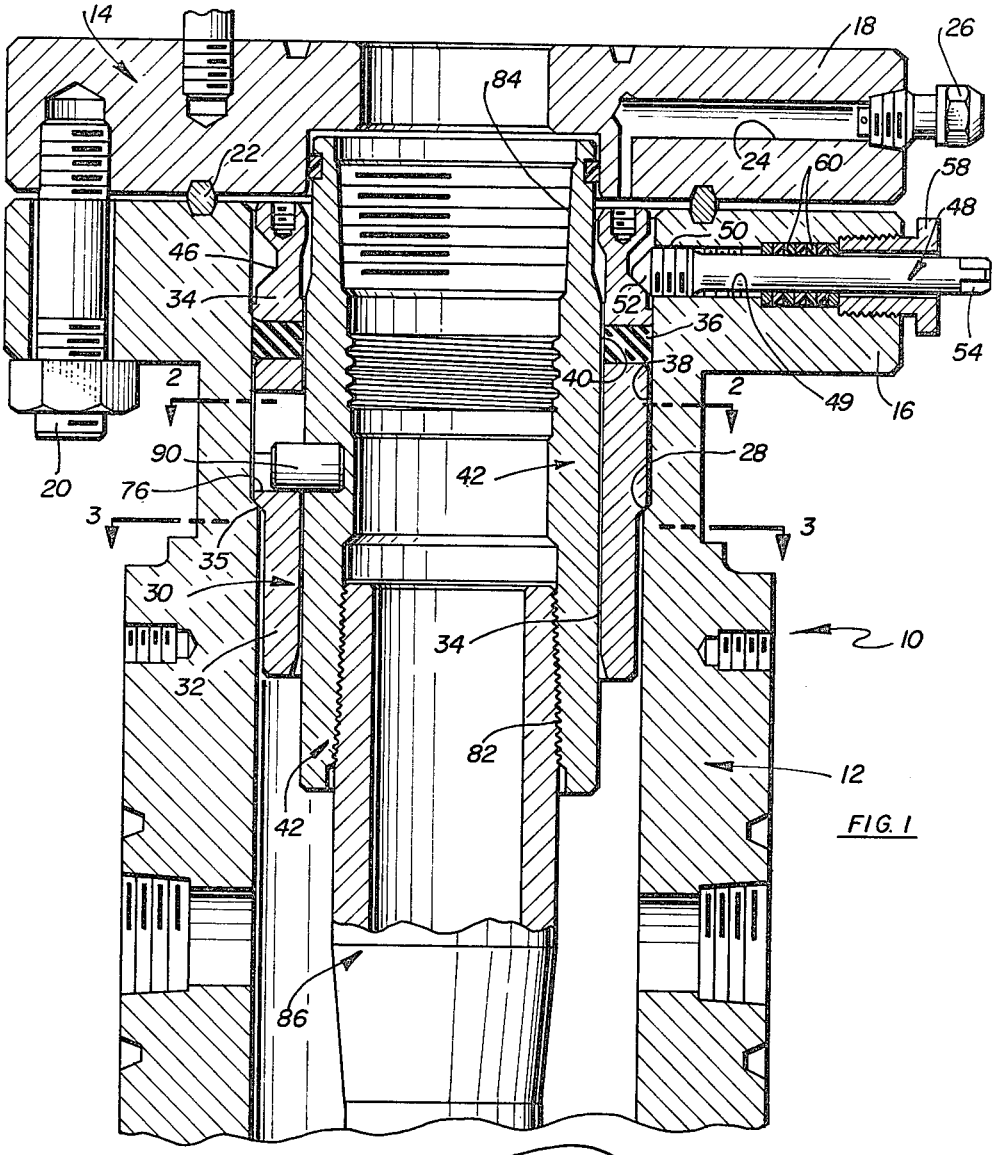
FIG. 1 is a cross sectional view of a wellhead assembly in accordance with the present invention and showing the tubing string supported in a longitudinally tensioned relation.
Figure 2:
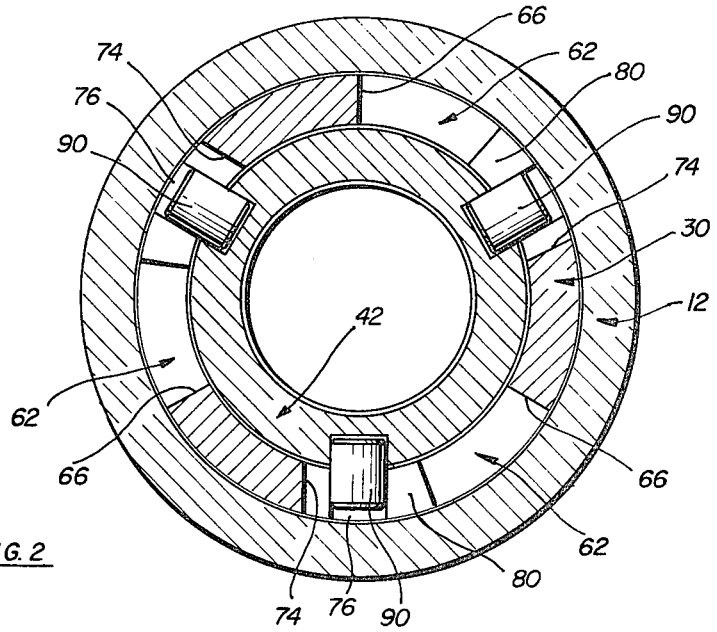
FIG. 2 is a section taken generally along the line 2—2 of FIG. 1.
Figure 3:
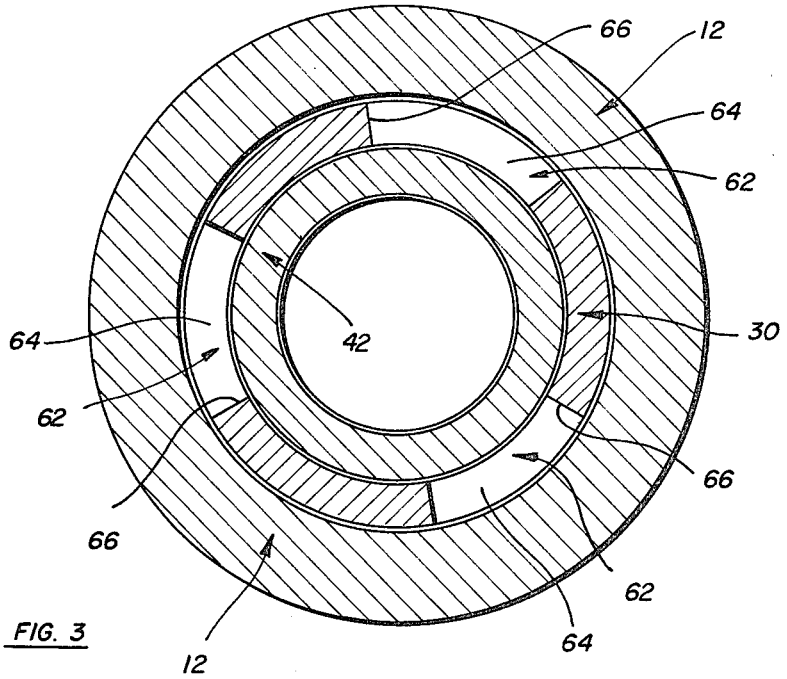
FIG. 3 is a section taken generally along line 3—3 of FIG. 1.

Referring now to the drawings for a better understanding of this invention and more particularly to FIGS. 1-3, the wellhead assembly is indicated generally at 10 and includes an outer tubing head generally indicated at 12 which has a flange adapter 14 fitting on the upper end thereof. Flange 16 of tubing head 12 and flange 18 of flange adapter 14 are bolted to each other by suitable stud and nut arrangements indicated at 20, suitable metallic seal 22 is mounted in grooves between flanges 16 and 18. A lubricant passage 24 in flange adapter 14 has a lubricant fitting 26. Tubing head 12 has an internal annular shoulder 28 on the inner periphery of tubing head 12.

A hanger bowl generally indicated at 30 has a lower portion 32 and an upper portion 34. Lower portion 32 has an outer annular shoulder 35 which is in contact with and is supported on shoulder 28 of tubing head 12. Upper portion 34 is mounted for longitudinal movement relative to lower portion 32 and an annular compressible rubber seal 36 is positioned between upper portion 34 and lower portion 36. Rubber seal 36 seals between inner peripheral surface 38 of tubing head 12 and outer peripheral surface 40 of a hanger indicated generally at 42. Upper portion 34 of hanger bowl 30 has an outer annular groove 46 therein. A plurality of holddown screws indicated generally at 48 are spaced about the outer periphery of flange 16 on tubing head 12 and fit within openings 49 in flange 16. Each screw 48 has an inner externally threaded body 50 with a tapered end 52 which fits within groove 46 in seated position. The outer end 54 of holddown screw 48 is formed to receive a wrench or the like for rotation of screw 48. A suitable nut 58 threaded within opening 49 is employed to compress packing rings 60 for sealing about holddown screw 48. Upon rotation of holddown screw 48 rubber seal 36 is compressed to seal against the adjacent peripheral surfaces. Screw 48 is shown in fully seated position in FIG. 1.

Three downwardly opening cam slots each generally indicated at 62 are provided in lower portion 32 of hanger bowl 30. Each cam slot 62 is identical and reference is made to FIG. 4 for illustration of cam slot 62. Cam slot 62 is of a generally inverted "J" configuration having a relatively wide entrance or mouth portion 64 defined by spaced apart side surfaces 66 and 68 which converge from mouth portion 64 to a narrow throat portion illustrated at 70. Side cam surface 66 curves to the left viewing FIG. 4 and terminates at an upper arcuate corner 72 which is joined by a downwardly extending guide surface 74 which leads to an arcuate seat 76 formed on a lower hook shaped portion 78 of hanger bowl 30. Seat 76 is of a generally semi-circular shape. A short horizontal surface 80 joins seat 76 and side cam surface 68.

Hanger 42 has an internally threaded lower end portion 82 and an upper internally threaded portion 84. A tubing string indicated generally at 86 is externally threaded at its upper end and is threaded within lower end portion 82. For movement of hanger 42 and suspended tubing string 86 as shown in FIG. 5 with flange adapter 14 removed, a mandrel 88 is threaded within upper threaded end portion 84 and is connected at its upper end to a suitable lift apparatus, such as a hoist (not shown) for lifting purposes. Three support pins 90 extend from the outer periphery of hanger 42 and are adapted to fit within cam slots 62 and to be seated in supporting relation on seats 72.

Referring particularly to FIG. 5, hanger 42 and tubing string 86 are illustrated in position as they are being raised or lifted by mandrel 88 for applying a desired longitudinal tensioning of tubing string 86. The amount of tensioning or stress which might be placed on tubing string 86 is determined by several factors, such as for example, the size of the tubing string 86, the type of material from which tubing string 86 is formed, the length of tubing string 86, and the temperature changes to which tubing string 86 might be exposed. In some instances, with tubing string 86 being around two thousand (2000) feet in length, the tubing may be stretched from three to ten feet.

For tensioning tubing string 86, tubing string 86 is lowered to a desired depth in casing 91 and a suitable packer indicated generally at 92 is actuated to secure the lower end of tubing string 86 within casing 91 as is well known. A packer which has been found to function satisfactorily for tensioning of a tubing string is illustrated in the 1978–1979 "Composite Catalog of Oil Field Equipment and Services", page 724, as Tension Packer-Model AD-1, manufactured by Baker Packers, 6023 Navigation Blvd., Houston, Tex. The packer may be suitably actuated by rotation of tubing string 86. After anchoring of the lower end of tubing string, mandrel 88 is lifted by the hoisting apparatus to lift hanger 42 and tubing string 86. The amount of lift or travel has been previously calculated to obtain the desired amount of tensioning and pins 90 are received within the entrances 64 of cam slots 62 as hanger 42 reaches hanger bowl 30. Pins 90 engage cam surfaces 66 and hanger 42 with tubing string 86 is rotated to the left viewing FIG. 4 until pins 90 reach arcuate corners 72. When pins 90 are stopped by arcuate corners 72, mandrel 88 is then lowered and guide surfaces 74 guide pins 90 downwardly to arcuate seats 76 in which position hanger 42 is seated with tubing string 86. Holddown screws 48 are then fully seated within groove 46 to compress rubber seal 36 against the adjacent peripheral surfaces 38 and 40.

Thus, a relatively simple arrangement of interfitting supporting elements of the hanger and hanger bowl are provided to permit tensioning of a tubing string by the lifting action of a mandrel and the subsequent seating of the hanger by lowering of the mandrel. No separate members or elements are required.

What is claimed is:

1. In a wellhead assembly having an outer tubing head, an intermediate hanger bowl supported on the tubing head, and an inner hanger having a tubing string supported therefrom; an improved means for tensioning the tubing string after anchoring the lower end of the tubing string comprising:

a plurality of cam slots in said hanger bowl extending upwardly from the lower end thereof, each slot being of a generally inverted "J" configuration having a relatively wide mouth portion at its lower end and being defined by a pair of spaced side surfaces converging from said mouth portion to a relatively narrow throat portion, one of said side surfaces of each slot having an upwardly directed portion extending from said mouth portion to an upper arcuate corner and a downwardly directed portion extending from the arcuate corner to a pin support;

said hanger having a plurality of pins secured to and extending outwardly from the outer periphery of the hanger for fitting within said cam slots and seating within the pin supports;

said pins upon lifting of the hanger and supported tubing string from a position below the hanger bowl being guided by the converging side surfaces of the cam slots to the throat portions and then to the upper arcuate corners at which location upward movement of the hanger and tubing string is stopped;

then upon a subsequent lowering of the hanger and tubing string, the pins ride along said downwardly directed portions and are seated in the pin supports for supporting the hanger and tubing string.

2. In a wellhead assembly as set forth in claim 1, wherein said one of said side surfaces slants from said mouth portion to said upper arcuate corner thereby effecting rotation of the hanger and tubing string as the associated pin rides along said one side surface to the arcuate corner.

3. In a wellhead assembly as set forth in claim 2, wherein the downwardly directed portion of said one side surface extending from said upper arcuate corner to the pin support slants from said arcuate corner in a direction opposite the slant of said upwardly directed portion to effect a reverse rotation of the hanger and tubing string as the associated pin rides along said downwardly directed portion to the pin support.

4. In a wellhead assembly as set forth in claim 3, wherein said pin support is of a generally semi-circular shape to receive the associated pin.

5. In a wellhead assembly having an outer tubing head, an intermediate hanger bowl supported on the tubing head, and an inner hanger having a tubing string supported therefrom; an improved means for tensioning the tubing string after anchoring the lower end of the tubing string comprising:

a plurality of cam slots in said hanger bowl extending upwardly from the lower end of the hanger bowl, each slot being formed by a pair of spaced cam surfaces, said cam surfaces being widely spaced at the lower end of the hanger bowl to form a relatively wide mouth portion and then leading from the mouth portion to a pin seat;

said hanger having a plurality of pins secured to and extending outwardly from the outer periphery of the hanger for fitting within said cam slots and seating within the pin seats;

said pins upon movement of the hanger and supported tubing string from a position below the hanger bowl being guided by the cam surfaces from the mouth portions to the pin seats for seating of the pins therein in a supporting relation to the hanger and tubing string.

6. In a wellhead assembly having an outer tubing head, an intermediate hanger bowl supported on the tubing head, and an inner hanger having a tubing string supported therefrom; an improved means for tensioning the tubing string after anchoring the lower end of the tubing string comprising:

a plurality of cam slots in said hanger bowl extending upwardly from the lower end of the hanger bowl each slot being defined by a pair of spaced side surfaces, said side surfaces being widely spaced at the lower end of the hanger bowl to form a relatively wide mouth portion and converging from said mouth portion, one of said surfaces having an upwardly directed portion extending from said mouth portion to an upper corner and a downwardly directed portion extending from the corner to a pin support;

said hanger having a plurality of pins secured to and extending outwardly from the outer periphery of the hanger for fitting within said cam slots;

each pin upon lifting of the hanger and supported tubing string relative to the hanger bowl being guided by said one side surface to the upper corner of the cam slot at which location the upward movement of the tubing string is stopped;

then upon a subsequent lowering of the hanger and tubing string, the pin is guided by said downwardly directed portion of said one side surface into a seated position on the pin support for supporting the tubing string.

7. A wellhead assembly having an outer support bowl, an inner concentric hanger supported within the bowl and having a tubing string connected thereto adapted to be tensioned after anchoring of the lower end of the tubing string;

a plurality of generally inverted "J"-shaped cam slots in said support bowl extending upwardly from the lower end of the bowl each slot being defined by a pair of spaced side surfaces, said side surfaces being widely spaced at the lower end of the bowl to form a relatively wide mouth portion and converging from said mouth portion, one of said side surfaces having an upwardly directed portion extending from said mouth portion to an arcuate upper corner and a downwardly directed portion extending from the arcuate corner to a generally semi-circular pin support;

said hanger having a plurality of pins secured to and extending outwardly from the outer periphery of the hanger for fitting within said cam slots;

each pin upon lifting of the hanger and supported tubing string relative to the bowl with the lower end of the tubing string secured being guided by said one side surface to the upper corner of the cam slot at which location the upward movement of the tubing string is stopped after a tensioning of the tubing string;

then upon a subsequent lowering of the hanger and tubing string, the pin is guided by said downwardly directed portion of said one side surface into a seated position on the pin support for supporting the tubing string.

* * * * *